United States Patent [19]

Becker

[11] 4,021,626

[45] May 3, 1977

[54] MECHANICAL LIGHT SWITCH TIMER

[76] Inventor: Robert R. Becker, 1500 Grissom Park Drive, Fullerton, Calif. 92633

[22] Filed: July 25, 1975

[21] Appl. No.: 599,171

[52] U.S. Cl. ..... 200/33 R; 200/38 A; 200/39 R

[51] Int. Cl.[2] ..... H01H 7/00

[58] Field of Search ..... 200/33 R, 33 B, 35 R, 200/35 H, 38 R, 38 A, 38 FA, 38 FB, 329–332, 337, 338, 39 R

[56] References Cited

UNITED STATES PATENTS

| | | | |
|---|---|---|---|
| 2,674,664 | 4/1954 | Clubb et wal. | 200/33 R |
| 2,937,247 | 5/1960 | Laviana et al. | 200/38 A |
| 3,179,758 | 4/1965 | Trock | 200/33 R X |
| 3,818,156 | 6/1974 | Augustyniak | 200/33 R |
| 3,819,885 | 6/1974 | Moroto et al. | 200/33 R |
| 3,985,982 | 10/1976 | Schneidinger | 200/33 R |

*Primary Examiner*—James R. Scott
*Attorney, Agent, or Firm*—William C. Babcock

[57] ABSTRACT

A switch articulating device in combination with a modified conventional timer, the device including a bistable auxiliary switch lever connected to a switch engaging shuttle bracket, the switch lever and the bracket being retained in a housing adapted for installation over a wall switch. The conventional mechanical timer is mounted on the exterior of the housing and is modified to provide a timer shaft attached to a cam and extending into the interior of the housing. The cam is aligned to oppose one end of rocker arm, which at the other end articulates, through a push plate, a bellcrank attached to the switch lever. In this manner the switch lever can be either articulated by the timer or can be manually controlled to operate the circuit.

8 Claims, 7 Drawing Figures

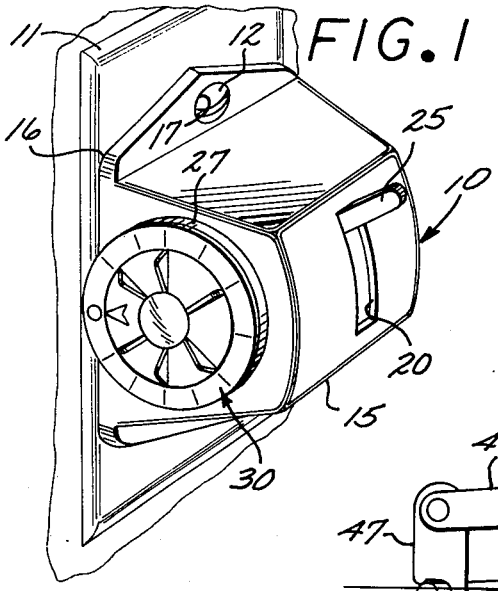
FIG. 1
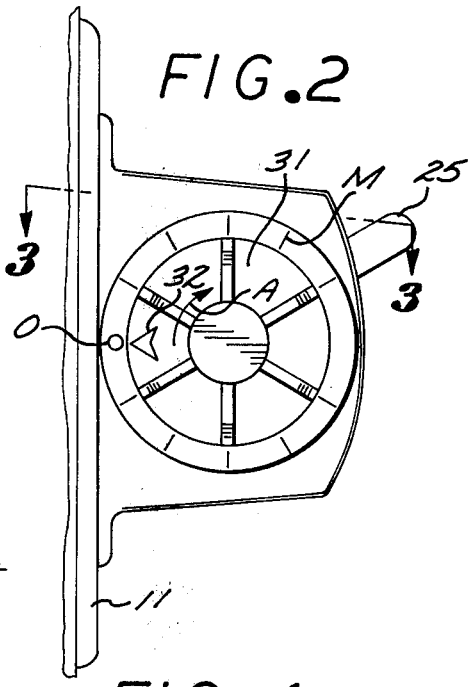
FIG. 2
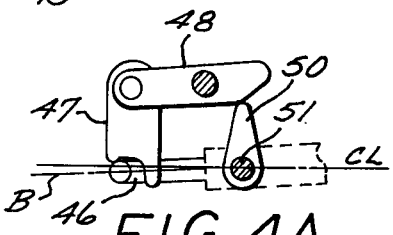
FIG. 4A
FIG. 3
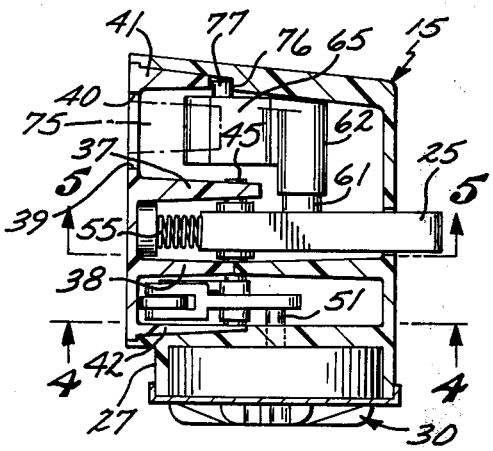
FIG. 4
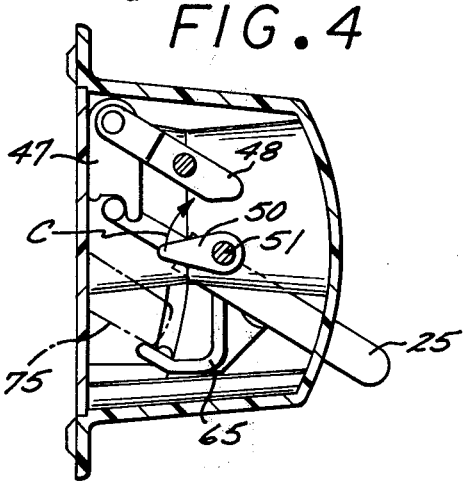
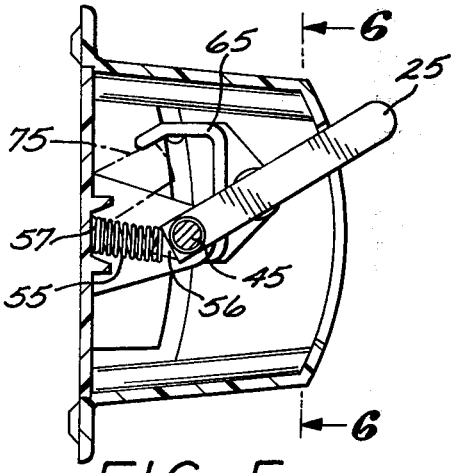
FIG. 5
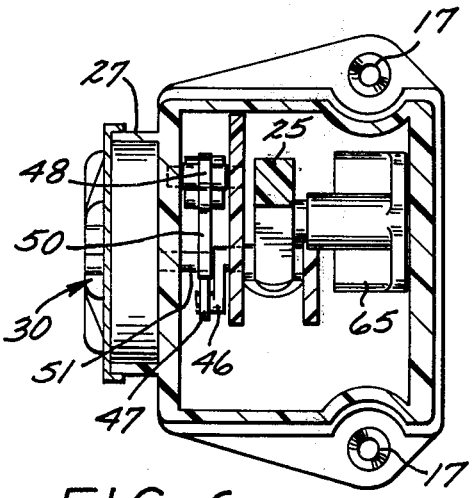
FIG. 6

MECHANICAL LIGHT SWITCH TIMER

BACKGROUND OF THE INVENTION

1. Field of the Invention

The present invention relates to timers, and more particularly to mechanical timers adapted to articulate a conventional light switch.

2. Description of Prior Art

Provisions for automatically controlling the duration of power out of a particular power outlet or a particular light source have been known in the past. Most often, however, such prior art timers all include electromechanical devices, and therefore, when installed by a typical home user entail electrical connections. Since electrical connections are not normally readily undertaken by what is commonly described as "Saturday mechanics", such prior art timers all experienced less than total acceptance in the market place. For that reason there are several prior art devices which adapt a mechanical timer to articulate a switch. Most often such prior art devices, however, do not allow for independent articulation of the switch or articulation of the switch independent of articulation of the mechanical timer. This feature again, renders the prior art mechanical timers less than fully acceptable.

SUMMARY OF THE INVENTION

Accordingly, it is the general purpose and object of the present invention to provide a mechanical timer which is particularly suited for mounting over a conventional switch plate, such timer incorporating an externally accessible switch lever which is capable of independent articulation.

Other objects of the invention are to adapt a mechanical timer to include at the output thereof, camming devices for articulating a switch.

Yet further objects of the invention are to provide a mechanical timer which can be directly mounted onto the exterior of a wall switch without entailing any additional electrical connections.

These and other objects are accomplished within the present invention by combining a mechanical timer such as the pocket timer sold under the trademark MEM0-PARK with an inventive switch assembly adapted to be directly attached at the two mounting screws of a switch plate. The timer assembly includes an externally projecting auxiliary lever or switch, spring-loaded to the bistable positions of a conventional switch, the auxiliary switch being eccentrically connected to a switch articulating shuttle which is disposed to engage the conventional operating switch of an electrical circuit. Thus, manual articulation of the auxiliary switch will concurrently articulate the circuit switch allowing for a direct control over the circuit.

In addition, the auxiliary switch is secured to a bellcrank, which through a push plate, is articulated in the closing direction by a cam rocker, where the rocker arm in turn is articulated at the other end by a cam extending from the abovementioned mechanical timer. More specifically, the mechanical timer is modified to provide a shaft thereof, such shaft being attached to a cam. The cam in turn is aligned to periodically engage by its lobe the rocker arm at which the other side is connected to the push plate. The direction of articulation of the push plate is to oppose the bellcrank when the auxiliary switch and therefore the circuit switch is in the on position. Thus, when the selected time set by the mechanical articulation of the mechanical timer has expired the cam, through the rocker arm and the push plate, drives the bellcrank towards the other stable position of the bistable auxiliary switch, turning the switch off.

By way of this arrangment of parts, the conventionally available mechanical timer is combined with a bistable auxiliary switching assembly which when driven by the timer from one bistable state to the other bistable state will concurrently articulate an electrical switch.

BRIEF DESCRIPTION OF THE DRAWING

FIG. 1 is a perspective illustration of the inventive timer mounted on a conventional switch;

FIG. 2 is a side view of the inventive timer shown in FIG. 1, illustrating the disposition of the mechanical timer therein;

FIG. 3 is a sectional view taken along line 3—3 of FIG. 2;

FIG. 4 is a sectional view taken along line 4—4 of FIG. 3;

FIG. 4A is a detailed illustration of the mechanism herein during switching;

FIG. 5 is yet another sectional view taken along line 5—5 of FIG. 3; and

FIG. 6 is a planform sectional view illustrating the details of the invention herein, taken along line 6—6 of FIG. 5.

DESCRIPTION OF THE SPECIFIC EMBODIMENT

While the foregoing description is directed at a mechanically timed switch assembly particularly suited for switch plate mounting, such is for purposes of illustration only. It is to be noted that various other bistable switches can be similarly provided at no intent to limit the invention is expressed by way of this illustration.

As shown in FIG. 1, the inventive timer assembly, generally designated by the numeral 10, is directly mounted onto a switch plate 11 by way of the two conventional switch plate mounting screws 12. This manner of mounting the timer assembly 10, assures alignment thereof relative to the switch extending from plate 11. Generally, assembly 10 comprises an external housing 15 disposed between two end tabs 16, which are provided with the requisite screw holes 17, aligned to receive screws 12 in switch plate 11. Extending from the front face of housing 15 through a slot 20 formed therein, is a bistable auxiliary switch 25, which according to means described below, allows for manual articulation of the wall switch in the switch plate 11. The alignment of switch 25 is fixed by holes 17 to one side of the switch plate. Housing 15 furthermore includes on one lateral surface thereof, a circular receiving skirt 27 conformed to receive a conventional prior art timer 30 such as the timer sold under the trade name MEMO-PARK.

As shown in FIG. 2, timer 30 is received within the skirt 27 on housing 15 in an arrangement exposing the face thereof. In detail, timer 30 includes a rotary face 31 marked with pointer 32 where the face can be manually rotated in the direction of the arrow A, to align the marker 32 against any selected timing mark M on the periphery of the timer. The timer then is mechanically advanced by the clock mechanism therein, in a direction opposed to the arrow A, and will continue to rotate at a predetermined rate until the end position is reached, that position being shown herein at the position O.

When in that position, according to means described below, switch 25 is articulated by a cam to switch over from the position shown to a downwardly directed position or a position corresponding to the off position of the wall switch.

As shown in more detail in FIGS. 3, 4, 4A, 5 and 6, switch 25 is pivotally mounted at the interior end thereof, between two mounting tabs 37 and 38 extending from a base plate 39 disposed across the base of housing 15. Base plate 39, further includes two lateral walls 41 and 42 extending normally therefrom, the exteriorly opposed surfaces of walls 41 and 42 being tapered on an inward taper toward the free ends thereof. The interior of housing 15 is similarly tapered in conforming fit over the sections engaging walls 41 and 42, to allow insertion of housing 15 over the walls to cover the base plate. Switch 25 pivotally mounted between tabs 38 and 37 includes a pivot shaft 45 secured rotatably relative thereto, such pivot shaft 45 extending through the tabs to project beyond tab 38 into the gap between that tab and wall 42. Within this interspace pivot 45 terminates in a bellcrank 46, which, at the free end is turned to oppose the free end of pivoted push plate 47, push plate 47 being pivotally secured at the other end to one end of a rocker arm 48. Rocker arm 48 is similarly mounted for pivotal articulation between the wall 42 and tab 38, opposing at the other end the lobe of a cam 50, secured at output shaft 51 and extending into housing 15 from the timer 30. As shown in FIG. 4A, the dimensions of the lobe of cam 50 and the convolution of the opposing surface on the rocker arm 48, together with the length of the push plate 47, are such that when the timer 30 reaches the position designated O, the bellcrank is pushed just beyond the neutrally stable point of switch 25. This is illustrated by way of the center line designated CL, indicating the neutrally stable point of switch 25 and a line designated B, indicating the slight bias toward the other bistable state.

As specifically shown in FIGS. 3 and 5, this bistable operation of switch 25 is achieved by compressing a helical spring 55 between the interior end of switch 25 and the base plate 39. More specifically the interior end of switch 25 is conformed to provide a conical tip, designated as tip 56 extending beyond the central axis of the pivot 45, and the base plate 39 is similarly provided with a conical projection 57 opposed thereto. Spring 55 is mounted to engage these conical projections at the respective ends thereof, being thus compressed during the eccentric motion of tip 56 to urge switch 25 to either one of two stable positions.

As shown in FIG. 4, switch 25 is in one of its bistable positions and the lobe of the timing cam 50 is shown rotated away from the opposing surface of the rocker arm 48. The mechanical action of timer 30 then advances cam 50 in the direction of arrow C to a point where the lobe of cam 50 begins to oppose rocker arm 48. In this position the rocker arm 48 is articulated according to the illustration in FIG. 4A to extend the push plate 47 against the bellcrank 46. When the timing cycle is completed the disposition of the lobe of cam 50 is such that the switch is pushed beyond its neutrally stable position to switch over to the other state.

Extending from one lateral surface of switch 25 at a point radially removed from the center of the pivot 45 is a shuttle engaging circular pin 61 which is received within a sleeve 62 formed on the upper surface of a traveller or shuttle bracket 65. Referrring back to FIGS. 3, 4, 5 and 6, the shuttle bracket or traveller 65 is conformed as a C-shaped bracket disposed for translation within the gap between wall 41 and tab 37 concurrent with the articulation of switch 25. In this position bracket 65 is disposed over an opening 40 formed in the base plate 39 through which a wall switch 75 projects into the interior of housing 15. To align the bracket 65 to a receiving alignment with switch 75 the peripheral free edge of wall 41 is cut off along an arcuate section and the interior of housing 15 is formed to provide a shoulder 76 separated by a gap from the above mentioned free edge. Received within this gap is a guide pin 77 formed to extend from one leg of the bracket 65, the combination of guide pins 77 and pin 61 in sleeve 62 thus acting to align the bracket 65 with the opening thereof towards the switch 75. Thus, guide pin 77 and sleeve 62 on the bracket will maintain the bracket in an aligned position during the articulating stroke of switch 25.

The operation of the present invention will now be set forth with particular reference to FIGS. 3, 4, 4A and 5. As shown in FIG. 3, housing 15 is placed over the switch plate 11 and aligned thereat by the retaining screws 12. In this position the wall switch 75 is received through opening 40 in the interior of housing 15 to engage bracket 65. To facilitate alignment during this installation step switch 25 is aligned to the same orientation as switch 75. The opening of bracket 65 is oversized, thus accommodating the various tolerances of articulation of switch 75. When thus installed the mechanical timer 30 can then be rotated to align the pointer 32 relative any desired timing mark M. This manual articulation of the mechanical timer concurrently rotates cam 50 away from the opposing rocker arm 48 releasing the rocker arm and allowing the desired articulation of switch 25. On release of the timer and the completion of the timing cycle thereof, the lobe of cam 50 rotates into opposition with the rocker arm 48, which then through the push plate 47 opposes the bellcrank 46. As illustrated in FIG. 4A the dimensions of the cam lobe of cam 50 and the push plate 47 are such that when the timer reaches its zero position the bellcrank 46 is pushed just slightly beyond the center of the neutral state after which the bistable mechanism of switch 25 throws the switch into the opposing state. When this throw is made the concurrent translation of bracket 65 also translates articulated switch 75 beyond its neutral point to the other state.

Some of the many advantages of the present invention should now be readily apparent. The invention provides by way of simple mechanical parts, a mechanical switch timer adapted for home use where the installation of the inventive switch timer does not entail any electrical connections. Furthermore, the invention provides independent articulation of the switch where, if the timing function is not desired, direct manual intervention can be made.

Obviously, many modifications and variations of the above embodiment will be apparent to those skilled in the art. It is therefore intended that the scope of the invention herein not be determined by the teachings above and be solely limited by the appended claims.

I claim:

1. Apparatus for automatically articulating an electrical switch comprising:

a housing adapted for mounting over said electrical switch;

a bistable lever pivotally mounted in said housing to project an exterior end therefrom for manual articulation between two stable positions;

a bracket disposed on the interior of said housing and pivotally secured to an interior projection on said lever and disposed to engage said electrical switch for articulating said switch concurrently with the articulation of said lever;

mechanical timing means mounted on said housing and adapted to extend a rotary shaft to the interior thereof;

actuating means disposed between said lever and said shaft for articulating said lever at selected positions of said shaft; and mounting means formed on said housing for securing said housing with said bracket in surrounding alignment over said switch.

2. Apparatus according to claim 1 wherein:

said actuating means includes a bellcrank extending from said lever, a cam mounted on the end of said shaft and a rocker arm pivotally mounted on the interior of said housing to oppose at one end thereof said cam and operatively connected at the other end thereof to articulate said bellcrank.

3. Apparatus according to claim 2 further comprising:

a pushplate disposed between said other end of said rocker arm and said bellcrank.

4. Apparatus according to claim 1 further comprising:

pivotal mounting means formed in said housing for engaging said lever, a first conical projection formed on the interior end of said lever distal of said pivotal mounting means, a second conical projection disposed in said housing in opposing relationship with said first conical projection and a helical spring compressed between said first and second conical projection.

5. Apparatus for articulating a wall switch extending from a switch plate, comprising:

a housing adapted for mounting on said switch plate to surround said wall switch;

a lever pivotally mounted in said housing to project to the exterior thereof for manual articulation;

spring means disposed between the pivoted end of said lever and said housing for providing two stable positions to said lever;

a bracket connected eccentrically to said lever and aligned to engage said wall switch for articulating said switch concurrently with the articulation of said lever;

timing means mounted on said housing and operatively connected to said lever for articulating said lever at a predetermined point in a preselected interval of time; and mounting means formed on said housing for securing said housing with said bracket in surrounding alignment over said switch.

6. Apparatus according to claim 5, further comprising:

actuating means disposed in said housing between said timing means and said lever including a cam mounted on said timing means to be advanced thereby, a rocker arm mounted on the interior of said housing to oppose said cam at one end thereof and a bellcrank connected to said lever and operatively aligned to oppose the other end of said rocker arm.

7. Apparatus according to claim 6, further comprising:

a pushplate disposal between said other end of said rocker arm and said bellcrank.

8. Apparatus according to claim 7 wherein:

said timing means includes a mechanical timer having manual adjusting means on the exterior thereof for manually selective said preselected interval of time, and a shaft connected to said cam cooperating to be advanced in rotation by said timer.

* * * * *